US012055326B2

(12) United States Patent
Mei et al.

(10) Patent No.: US 12,055,326 B2
(45) Date of Patent: Aug. 6, 2024

(54) CONDENSER

(71) Applicants: York (Wuxi) Air Conditioning and Refrigeration Co., Ltd., Wuxi (CN); Johnson Controls Technology Company, Auburn Hills, MI (US)

(72) Inventors: Lu Mei, Wuxi (CN); Xiuping Su, Wuxi (CN)

(73) Assignee: TYCO FIRE & SECURITY GMBH, Schaffhausen (CH)

( * ) Notice: Subject to any disclaimer, the term of this patent is extended or adjusted under 35 U.S.C. 154(b) by 0 days.

(21) Appl. No.: 17/263,844

(22) PCT Filed: Jul. 26, 2019

(86) PCT No.: PCT/CN2019/097919
§ 371 (c)(1),
(2) Date: Jan. 27, 2021

(87) PCT Pub. No.: WO2020/020349
PCT Pub. Date: Jan. 30, 2020

(65) Prior Publication Data

US 2021/0310705 A1 Oct. 7, 2021

(30) Foreign Application Priority Data

Jul. 27, 2018 (CN) ..... 201810843447.3
Jul. 27, 2018 (CN) ..... 201821214503.9

(51) Int. Cl.
*F25B 39/04* (2006.01)
*F28D 7/16* (2006.01)
*F28F 9/00* (2006.01)

(52) U.S. Cl.
CPC ..... *F25B 39/04* (2013.01); *F28D 7/1638* (2013.01); *F28F 9/005* (2013.01); *F25B 2339/0446* (2013.01); *F25B 2339/045* (2013.01)

(58) Field of Classification Search
CPC ..... F25B 39/04; F25B 2339/0446; F25B 2339/045; F28B 1/02; F28D 7/1638;
(Continued)

(56) References Cited

U.S. PATENT DOCUMENTS 2,138,469 A * 11/1938 Barclay ..... F28D 7/1646 165/161
2,607,567 A * 8/1952 Hobbs ..... F28D 7/06 165/110

(Continued)

FOREIGN PATENT DOCUMENTS

CN 205279536 U 6/2016
CN 205279537 U 6/2016

(Continued)

OTHER PUBLICATIONS

PCT International Search Report for PCT Application No. PCT/CN2019/097919 mailed Oct. 29, 2019, 5 pgs.

(Continued)

*Primary Examiner* — Eric S Ruppert
*Assistant Examiner* — Hans R Weiland
(74) *Attorney, Agent, or Firm* — Fletcher Yoder, PC

(57) ABSTRACT

A condenser (100), comprising a shell (112), an inlet pipe (120), and an anti-impact plate (204). The shell (112) has an accommodating cavity (202). The inlet pipe (120) is a circular pipe having a gradually increasing inner diameter from the inlet to the outlet. The inlet pipe (120) is arranged to pass through the upper end of the shell (112), the outlet of the inlet pipe (120) being accommodated in the accom-
(Continued)

modating cavity (202). The anti-impact plate (204) is accommodated in the accommodating cavity (202), and the anti-impact plate (204) is positioned below the outlet of the inlet pipe (120). There is a gap between the anti-impact plate (204) and the outlet through which fluid flowing from the outlet can flow. The condenser (100) can reduce the friction loss and local resistance of the refrigerant gas flowing into the inlet pipe (120), such that the dynamic pressure of the refrigerant gas entering the condenser (100) is partially converted into static pressure, and reduce the static pressure loss of the refrigerant gas entering the cylinder from the inlet, thereby increasing the condensing pressure of the refrigerant gas in the condenser (100) to enhance the heat exchange performance.

20 Claims, 10 Drawing Sheets

(58) Field of Classification Search
CPC ..... F28F 9/005; F28F 9/0263; F28F 9/0265; F28F 2009/222; F28F 2009/226
See application file for complete search history.

(56) References Cited

U.S. PATENT DOCUMENTS 3,180,405 A * 4/1965 Hinde ..... F28F 9/0132 165/184
4,252,186 A * 2/1981 Starner ..... F28B 1/02 165/161
5,465,783 A * 11/1995 O'Connor ..... F28F 19/00 165/174
9,157,690 B2 * 10/2015 Kreis ..... F28D 3/04
2001/0017202 A1 8/2001 Mitsumoto et al.
2005/0144976 A1 7/2005 Sishtla
2007/0028647 A1 * 2/2007 Wang ..... F28F 9/0265 62/506
2009/0000775 A1 * 1/2009 Al-Hadhrami ..... F28F 19/00 165/134.1
2009/0242178 A1 * 10/2009 Al-Anizi ..... F28F 19/00 165/134.1
2016/0377331 A1 12/2016 Su et al.
2018/0224172 A1 * 8/2018 Moreaux ..... F28D 7/1646
2018/0231280 A1 * 8/2018 Moreaux ..... F28B 1/02
2019/0219314 A1 * 7/2019 Stark ..... F25B 39/04

FOREIGN PATENT DOCUMENTS

CN 206113725 U 4/2017
CN 109141077 A 1/2019
CN 208872149 U 5/2019
WO 2019075096 A1 4/2019

OTHER PUBLICATIONS

European Search Report for EP Application No. 19840963.3, dated Mar. 7, 2022, 6 pgs.

* cited by examiner

CONDENSER

CROSS-REFERENCE TO RELATED APPLICATIONS

This application is a U.S. National Stage Application of PCT Application No. PCT/CN2019/097919, entitled "CONDENSER," filed Jul. 26, 2019, which claims priority to Chinese Application No. 201810843447.3, filed Jul. 27, 2018, and Chinese Application No. 201821214503.9, filed Jul. 27, 2018, each of which is herein incorporated by reference in its entirety for all purposes.

TECHNICAL FIELD

The present application relates to the field of heat exchangers, more precisely to a condenser.

BACKGROUND ART

A housing of a condenser contains heat exchange tubes; an inlet pipe of the condenser is generally arranged at an upper part of the condenser, and gaseous fluid enters the housing of the condenser through the inlet pipe of the condenser. Since the speed of the gaseous fluid is relatively high, the gaseous fluid can easily cause the heat exchange tubes to rupture if it strikes them directly.

SUMMARY OF THE INVENTION

A demonstrative embodiment of the present application can solve at least some of the abovementioned problems.

The present application provides a condenser, comprising a housing, an inlet pipe and an anti-impact plate. The housing has an accommodating cavity. The inlet pipe is a round pipe with an internal diameter that gradually increases from an inlet to an outlet. The inlet pipe is configured to pass through an upper part of the housing, and the outlet of the inlet pipe is accommodated in the accommodating cavity. The anti-impact plate is accommodated in the accommodating cavity, and located below the outlet of the inlet pipe, and a gap is provided between the anti-impact plate and the outlet, the gap allowing through-flow of a fluid flowing out of the outlet.

According to the condenser described above, on the anti-impact plate, the outlet of the inlet pipe has a projected region in an axial direction of the inlet pipe, the projected region being a hole-free zone.

According to the condenser described above, the internal diameter of the inlet pipe increases smoothly from the inlet to the outlet.

According to the condenser described above, the inlet of the inlet pipe has an inlet area $A_1$; a surface formed by vertically downward extension of an edge of the outlet of the inlet pipe to the anti-impact plate has an outlet extension area $A_2$; the ratio AreaRatio of the inlet area $A_1$ to the outlet extension area $A_2$ satisfies:

$$\text{AreaRatio} = -b * \ln\left(\frac{Cv - c}{a}\right)$$

wherein the range of values of a is greater than −2000 and less than 0; the range of values of b is greater than 0 and less than 20; the range of values of c is greater than 0 and less than 200; and the range of values of a pressure recovery coefficient Cv is greater than 0.4 and less than 0.65.

According to the condenser described above, the range of values of the ratio AreaRatio=$A_2/A_1$ is greater than or equal to 1.65 and less than or equal to 3.

According to the condenser described above, the outlet extension area $A_2$ is determined at least partially on the basis of the circumference of the outlet and the gap H.

According to the condenser described above, in an axial section, a curve of an inner wall of the inlet pipe satisfies any one or more of the following curves:

$(x-f)^2+(y-g)^2=h^2$, wherein the range of values of f is greater than −1 and less than 1, the range of values of g is greater than 0 and less than 100, and the range of values of h is greater than 0 and less than 100;

$y=lx^2+mx+n$, wherein the range of values of l is greater than 0, the range of values of m is greater than −10 and less than 10, and the range of values of n is greater than −20 and less than 20;

$y=ox^3+px^2+qx+s$, wherein the range of values of o is greater than 0, the range of values of p is greater than −10 and less than 10, the range of values of q is greater than −20 and less than 20, and the range of values of s is greater than 0 and less than 100;

$$\frac{y^2}{u^2} - \frac{x^2}{v^2} = 1,$$

wherein the range of values of u is such that the absolute value of u is greater than 4 and less than 8, and the range of values of v is such that the absolute value of v is greater than 1 and less than 2.

According to the condenser described above, the anti-impact plate is configured such that the fluid flows past at least a part of an edge of the anti-impact plate along an upper surface of the anti-impact plate.

According to the condenser described above, two side edges of the anti-impact plate in a width direction of the condenser are bent upward.

According to the condenser described above, the anti-impact plate is connected to the housing by means of two side edges of the anti-impact plate in a width direction of the condenser.

The condenser of the present application can reduce frictional loss and local resistance of a refrigerant gas flowing into the inlet pipe, such that dynamic pressure of the refrigerant gas entering the condenser is partially converted to static pressure, and a static pressure loss when the refrigerant gas enters the tubular body through the inlet is reduced, thereby increasing the condensing pressure of the refrigerant gas in the condenser, so as to enhance the heat exchange performance.

BRIEF DESCRIPTION OF THE DRAWINGS

A better understanding of the features and advantages of the present application can be gained by reading the following detailed explanation with reference to the drawings; in all of the drawings, identical reference labels indicate identical components, wherein.

DETAILED DESCRIPTION OF THE INVENTION

Figure 1:
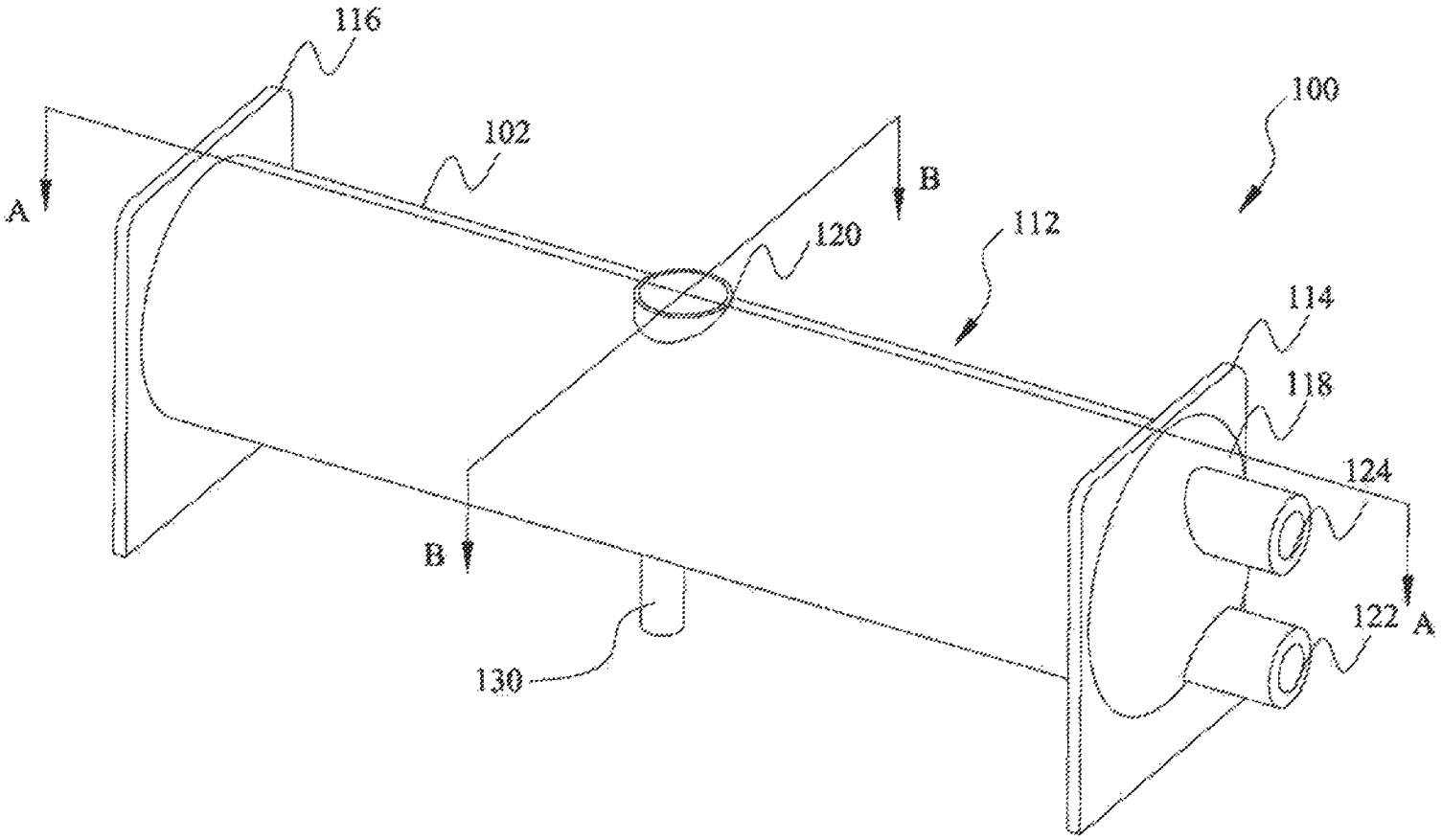
FIG. 1 is a three-dimensional drawing of a condenser in an embodiment of the present application.

Various particular embodiments of the present invention are described below with reference to the accompanying drawings, which form part of this Description. It should be understood that although terms indicating direction, such as "front", "rear", "up", "down", "left" and "right", etc. are used in the present invention to describe various demonstrative structural parts and elements of the present invention in a directional or orientational manner, these terms are used here purely in order to facilitate explanation, and are determined on the basis of demonstrative orientations shown in the drawings. Since the embodiments disclosed in the present invention may be arranged in accordance with different directions, these terms indicating direction are purely illustrative, and should not be regarded as limiting. In the drawings below, identical components use identical reference labels, and similar components use similar reference labels.

Figure 2A:
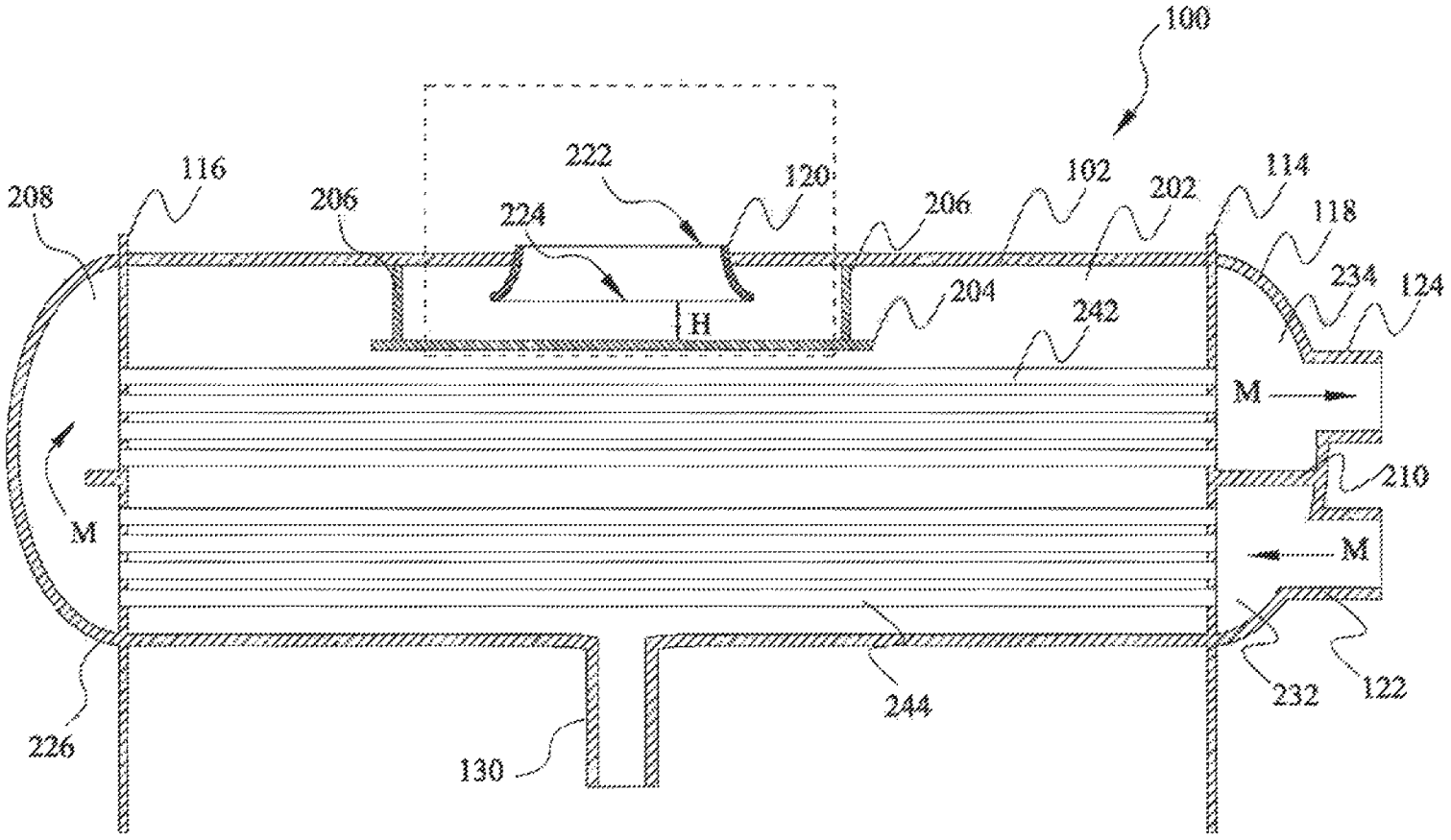
FIG. 2A is a sectional view, taken along section line A-A in FIG. 1, of the condenser in FIG. 1.
Figure 2B:
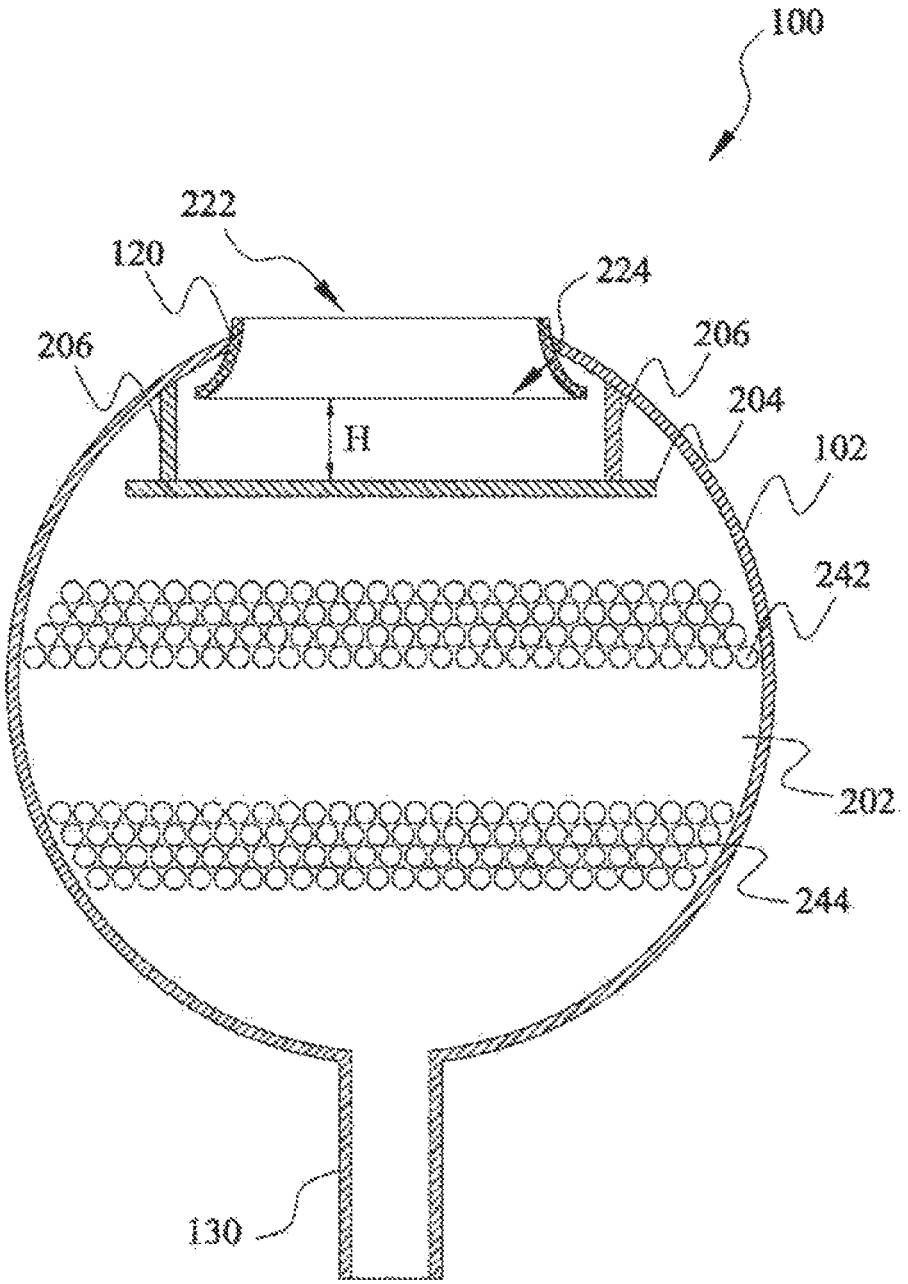
FIG. 2B is a sectional view, taken along section line B-B in FIG. 1, of the condenser in FIG. 1.

FIG. 1 is a three-dimensional drawing of a condenser 100 in an embodiment of the present application. FIG. 2A is a sectional view, taken along section line A-A in FIG. 1, of the condenser 100 in FIG. 1. FIG. 2B is a sectional view, taken along section line B-B in FIG. 1, of the condenser 100 in FIG. 1. As shown in FIGS. 1-2B, the condenser 100 comprises a housing 112. The housing 112 comprises a tubular body 102, a left dividing plate 116, a right dividing plate 114, a left end plate 226 and a right end plate 118. The tubular body 102 is formed to extend in a length direction of the condenser 100. Left and right ends of the tubular body 102 are closed by the left dividing plate 116 and right dividing plate 114 respectively, so as to form an accommodating cavity 202. The left end plate 226 is arc-shaped; the left end plate 226 is connected to the left dividing plate 116 to form a communicating cavity 208. The right end plate 118 is also arc-shaped; the right end plate 118 is connected to the right dividing plate 114. The right dividing plate 114 further comprises a transverse dividing plate 210 extending transversely from the right dividing plate 114 to the right end plate 118, thereby forming an outlet accommodating cavity 234 and an inlet accommodating cavity 232. The housing 112 further comprises a medium inlet pipe 122 and a medium outlet pipe 124; the medium inlet pipe 122 and medium outlet pipe 124 are disposed on the right end plate 118, the medium inlet pipe 122 being in fluid communication with the inlet accommodating cavity 232, and the medium outlet pipe 124 being in fluid communication with the outlet accommodating cavity 234.

As shown in FIGS. 1 and 2A, the condenser 100 further comprises a first tube bundle 242, and a second tube bundle 244 located below the first tube bundle 242. The first tube bundle 242 and second tube bundle 244 are horizontally installed in the accommodating cavity 202, and extend in the length direction of the condenser 100. One end of the first tube bundle 242 is in fluid communication with the communicating cavity 208, and another end of the first tube bundle 242 is in fluid communication with the outlet accommodating cavity 234; one end of the second tube bundle 244 is in fluid communication with the communicating cavity 208, and another end of the second tube bundle 244 is in fluid communication with the inlet accommodating cavity 232, such that a cooling medium can pass through the medium inlet pipe 122 and then flow through the inlet accommodating cavity 232, the second tube bundle 244, the communicating cavity 208, the first tube bundle 242 and the outlet accommodating cavity 234 in sequence, and flow out of the condenser 100 via the medium outlet pipe 124 (in the flow direction indicated by the arrows M in FIG. 2A). The condenser 100 further comprises an inlet pipe 120 and an outlet pipe 130. The inlet pipe 120 is located at an upper part of the tubular body 102, and configured to receive a refrigerant gas. The outlet pipe 130 is located at a lower part of the tubular body 102, and configured to discharge condensed refrigerant liquid from the tubular body 102. The refrigerant gas that flows into the tubular body 102 through the inlet pipe 120 undergoes heat exchange with a medium in the first tube bundle 242 and second tube bundle 244, and after being condensed into refrigerant liquid, can be discharged from the tubular body 102 via the outlet pipe 130.

The condenser 100 further comprises an anti-impact plate 204. As an example, the anti-impact plate 204 is substantially a flat plate and is installed transversely in the accommodating cavity 202. The anti-impact plate 204 is arranged below the inlet pipe 120, and located above the first tube bundle 242, such that when the refrigerant gas flows into the tubular body 102 through the inlet pipe 120 at a relatively high speed, the anti-impact plate 204 can prevent the refrigerant gas from directly striking the first tube bundle 242, so as to avoid rupture of the first tube bundle 242. In addition, the anti-impact plate 204 is also arranged to be separated from an outlet 224 of the inlet pipe 120 by a gap H, so that refrigerant fluid can flow toward the first tube bundle 242 and second tube bundle 244 after flowing out of the outlet 224. The anti-impact plate 204 is welded to the tubular body 102 by means of a pair of connecting rods 206.

Figure 3:
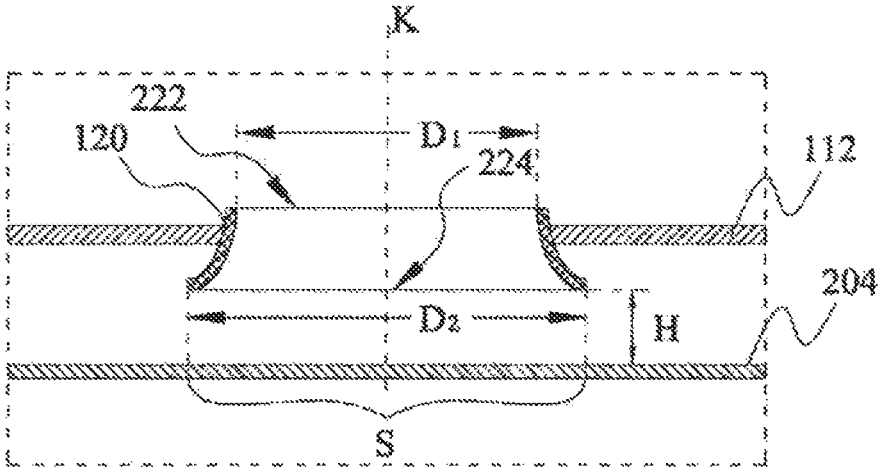
FIG. 3 is a partial enlarged view of FIG. 2A.

FIG. 3 is an enlarged drawing of the part enclosed by dotted lines in FIG. 2A, intended to show in greater detail an embodiment of the structure of the inlet pipe 120 and the anti-impact plate 204. As shown in FIG. 3, the inlet pipe 120 is a round pipe with an internal diameter that gradually increases from an inlet 222 to the outlet 224, and has a central axis K. The inlet pipe 120 passes through an upper part of the housing 112, and the outlet 224 of the inlet pipe 120 is accommodated in the accommodating cavity 202. The inlet 222 of the inlet pipe 120 has internal diameter $D_1$, and the outlet 224 of the inlet pipe 120 has internal diameter $D_2$; the internal diameter of the inlet pipe 120 increases smoothly from the internal diameter $D_1$ of the inlet 222 to the internal diameter $D_2$ of the outlet 224. On the anti-impact plate 204, the outlet 224 of the inlet pipe 120 has a projected region S projected vertically downward along the central axis K of the inlet pipe 120. The projected region S is a hole-free zone, so that the refrigerant gas can flow past at least a part of an edge of the anti-impact plate 204 along an upper surface of the anti-impact plate 204 and then come into contact with the first tube bundle 242, thereby preventing the refrigerant gas from striking the first tube bundle 242 directly.

Figure 4:
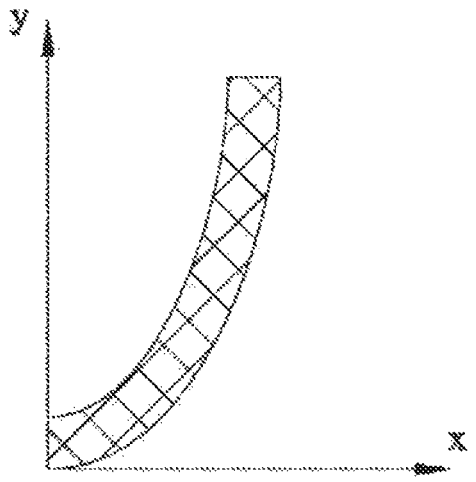
FIG. 4 is a schematic drawing of part of an axial section of the inlet pipe in FIG. 3.

FIG. 4 is a schematic drawing of part of an axial section of the inlet pipe 120 in FIG. 3, intended to show the specific shape of an inner wall of the inlet pipe 120. Here, x represents distance of the inner wall of the inlet pipe 120 on the axial section, in a direction perpendicular to the central axis K; y represents distance of the inner wall of the inlet pipe 120 on the axial section, in a direction parallel to the central axis K. In the axial section, a curve of the inner wall of the inlet pipe 120 satisfies any one or more of the following curves, wherein f, g, h, l, m, n, o, p, q, u and v represent constants:

$(x-f)^2+(y-g)^2=h^2$, wherein the range of values of f is greater than −1 and less than 1, the range of values of g is greater than 0 and less than 100, and the range of values of h is greater than 0 and less than 100;

$y=lx^2+mx+n$, wherein the range of values of l is greater than 0, the range of values of m is greater than −10 and less than 10, and the range of values of n is greater than −20 and less than 20;

$y=ox^3+px^2+qx+s$, wherein the range of values of o is greater than 0, the range of values of p is greater than −10 and less than 10, the range of values of q is greater than −20 and less than 20, and the range of values of s is greater than 0 and less than 100;

$$\frac{y^2}{u^2}-\frac{x^2}{v^2}=1,$$

wherein the range of values of u is such that the absolute value of u is greater than 4 and less than 8, and the range of values of v is such that the absolute value of v is greater than 1 and less than 2.

The smooth and gradual widening of the internal diameter of the inlet pipe 120 from the internal diameter $D_1$ of the inlet 222 to the internal diameter $D_2$ of the outlet 224 can reduce frictional loss of the refrigerant gas flowing into the inlet pipe 120, and this kind of gradually widening structure can also reduce local resistance of the refrigerant gas.

As an example, the inlet pipe 120 is a pipe of equal thickness. As another example, the inlet pipe may also be a pipe of non-equal thickness.

Figure 5:
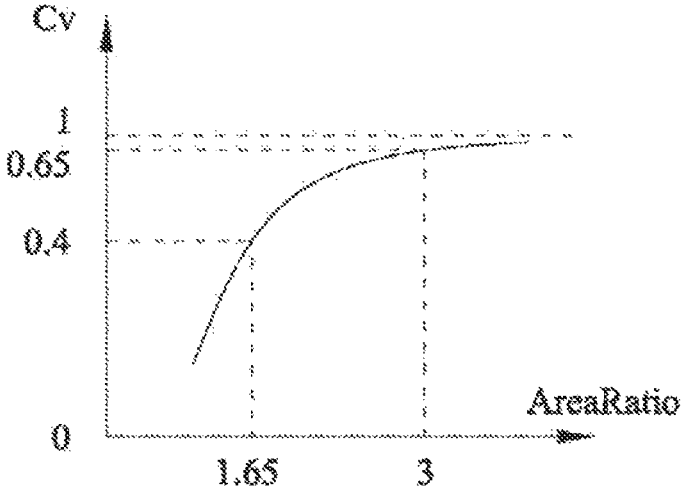
FIG. 5 is a schematic chart of the variation of a pressure recovery coefficient Cv of the inlet pipe in FIG. 1 with respect to a ratio AreaRatio.

FIG. 5 is a schematic chart of the variation of a pressure recovery coefficient Cv of the inlet pipe 120 in FIG. 1 with respect to a ratio AreaRatio. Here, the inlet 222 of the inlet pipe 120 has an inlet area $A_1$, a surface formed by vertically downward extension of an edge of the outlet 224 of the inlet pipe 120 to the anti-impact plate (204) has an outlet extension area $A_2$, and the ratio AreaRatio represents the ratio of the inlet area $A_1$ to the outlet extension area $A_2$. The pressure recovery coefficient Cv represents the ratio of conversion of dynamic pressure of the refrigerant gas entering the condenser 100 to static pressure. For example, when the pressure recovery coefficient Cv is 0.3, this indicates that 30% of dynamic pressure is converted to static pressure. Specifically, when the ratio AreaRatio satisfies the following formula, the structural arrangement of the inlet pipe 120 and anti-impact plate 204 can cause the dynamic pressure of the refrigerant gas entering the condenser 100 to be partially converted to static pressure and reduce the static pressure loss when the refrigerant gas enters the tubular body 102 through the inlet 222, thereby increasing the condensing pressure of the refrigerant gas in the condenser 100, so as to enhance the heat exchange performance.

As shown in FIG. 5, the relationship between the pressure recovery coefficient Cv and the ratio AreaRatio satisfies:

$$\text{AreaRatio}=-b*\ln\left(\frac{Cv-c}{a}\right)$$

wherein the range of values of a is greater than −2000 and less than 0;

the range of values of b is greater than 0 and less than 20;

the range of values of c is greater than 0 and less than 200; and the range of values of the pressure recovery coefficient Cv is greater than 0.4 and less than 0.65.

As an example, the range of values of the ratio $\text{AreaRatio}=A_2/A_1$ is greater than or equal to 1.65 and less than or equal to 3.

Figure 6A:
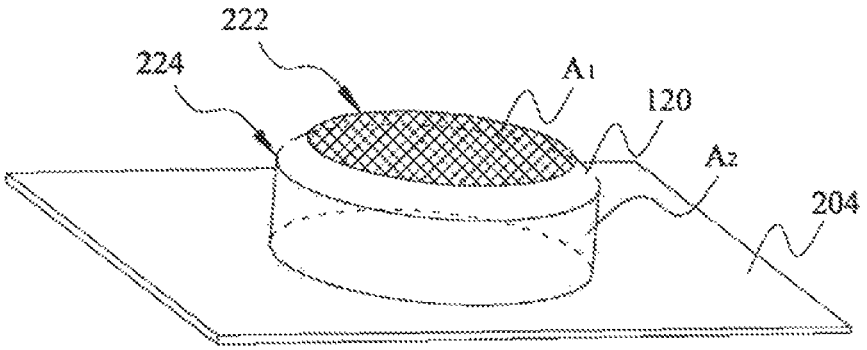
FIGS. 6A-6C are schematic drawings of the relative positional relationship of the inlet pipe and the anti-impact plate in the embodiment shown in FIG. 2A.
Figure 6B:
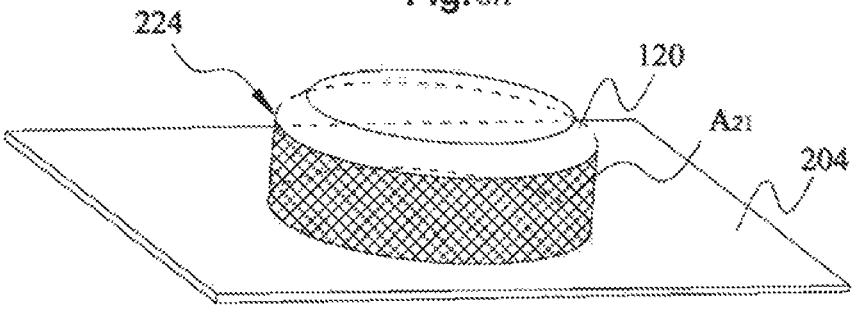
Figure 6C:
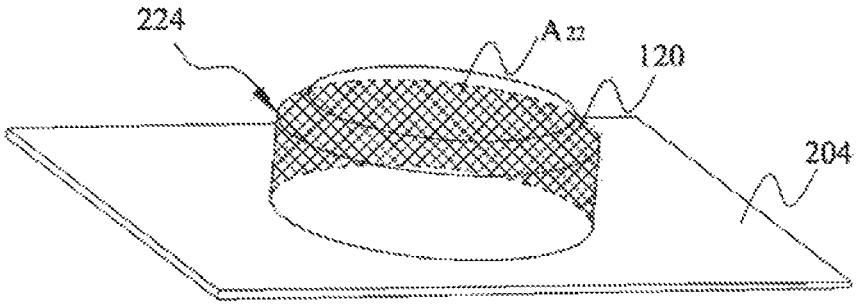

FIGS. 6A-6C are schematic drawings of the relative positional relationship of the inlet pipe 120 and the anti-impact plate 204 in the embodiment shown in FIG. 2A, wherein FIG. 6A is intended to show the inlet area $A_1$ of the inlet 222, and FIGS. 6B-6C are intended to show the outlet extension area $A_2$. As shown in FIG. 6A, the shaded part in FIG. 6A indicates the inlet area $A_1$ of the inlet 222, wherein the inlet area $A_1$ is determined by the internal diameter $D_1$ of the inlet 222. Specifically, the inlet area $A_1$ and the internal diameter $D_1$ of the inlet 222 satisfy:

$$A_1=\frac{1}{4}\pi D_1^2$$

The surface formed by vertically downward extension of the edge of the outlet 224 to the anti-impact plate 204 is an imaginary surface, which is a cylindrical surface and has the outlet extension area $A_2$.

As shown in FIGS. 6B-6C, the sum of a shaded part $A_{21}$ in FIG. 6B and a shaded part $A_{22}$ in FIG. 6C is the outlet extension area $A_2$. Specifically, the shaded part $A_{21}$ in FIG. 6B represents a part of the outlet extension area $A_2$ that is visible at the visual angle of FIG. 6B (which is the same as the visual angle of FIG. 6C), and the shaded part $A_{22}$ in FIG. 6C represents another part of the outlet extension area $A_2$ that is not visible at the visual angle of FIG. 6C (which is the same as the visual angle of FIG. 6B).

More specifically, the area $A_2$, the internal diameter $D_2$ of the outlet 224, and the gap H between the outlet 224 and the anti-impact plate 204 satisfy:

$$A_2=\pi HD_2$$

That is, the outlet extension area $A_2$ is related to the circumference of the outlet 224 and the gap H between the outlet 224 and the anti-impact plate 204.

Figure 7A:
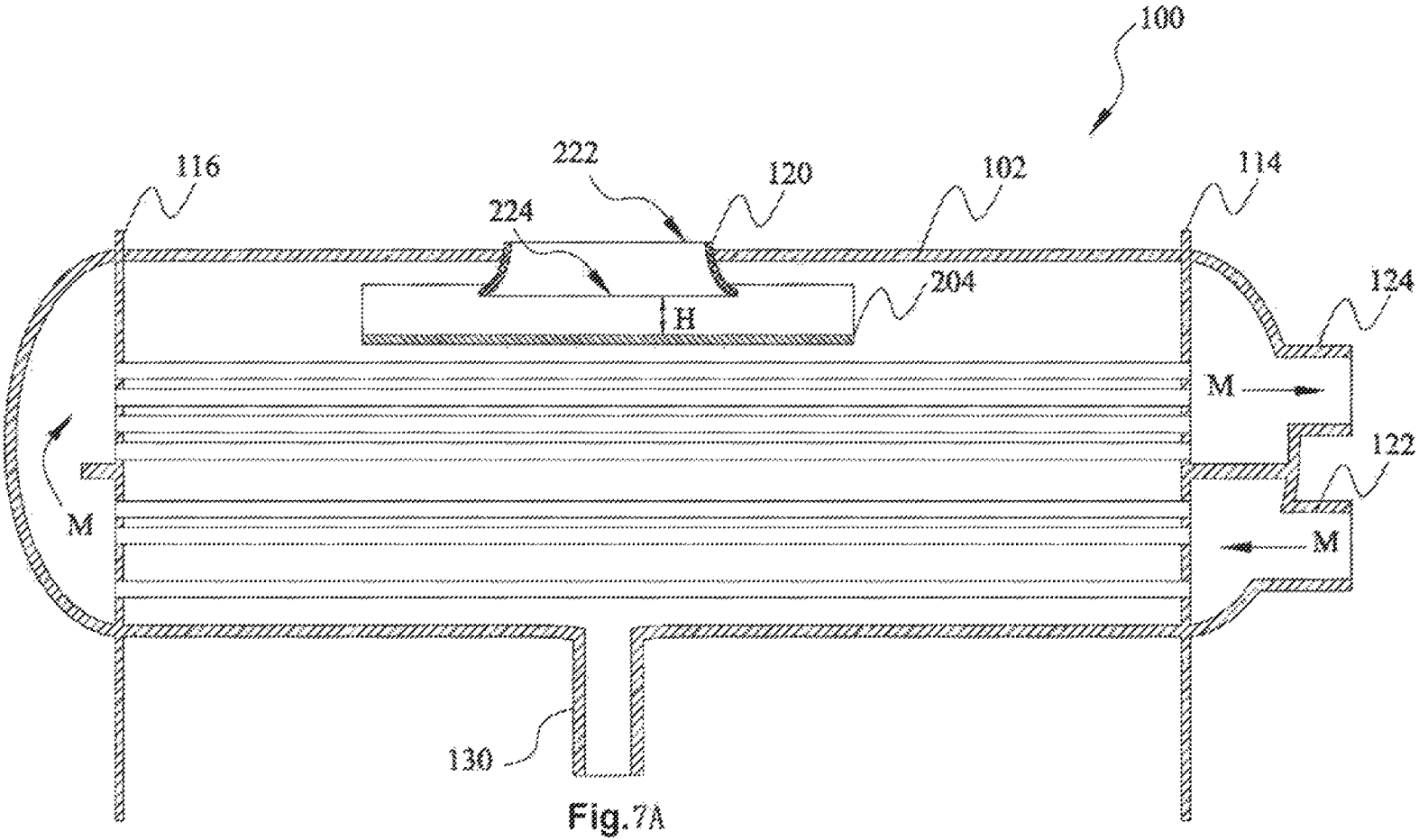
FIG. 7A is a sectional view, taken along section line A-A in FIG. 1, of the condenser according to another embodiment of the present application.
Figure 7B:
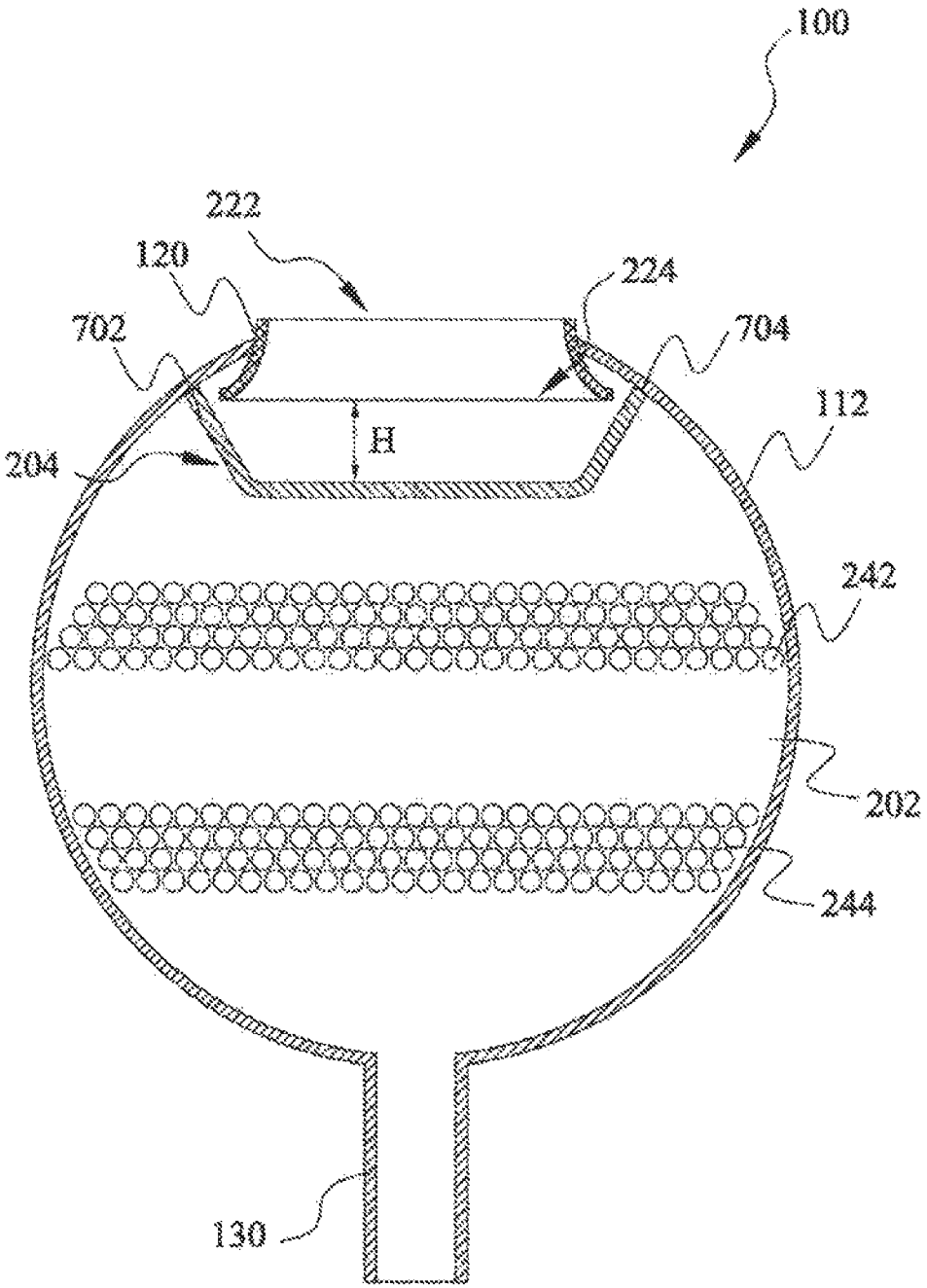
FIG. 7B is a sectional view, taken along section line B-B in FIG. 1, of the condenser in FIG. 7A.

FIG. 7A is a sectional view, taken along section line A-A in FIG. 1, of the condenser 100 according to another embodiment of the present application. FIG. 7B is a sectional view, taken along section line B-B in FIG. 1, of the condenser 100 in FIG. 7A. In the condenser 100 shown in FIGS. 7A-7B, except for the different structure of the anti-impact plate 204, the configurations of all the other components are the same as in FIGS. 2A-2B, so are not described again here. Specifically, in the embodiment shown in FIGS. 7A-7B, two side edges of the anti-impact plate 204 in a width direction of the condenser 100 (i.e. perpendicular to the length direction of the tubular body 102) are bent upward, to form extension parts 702, 704 extending upward, and a connection with the housing 112 is made by means of the two side edges of the anti-impact plate 204 in the width direction of the condenser 100.

Figure 8A:
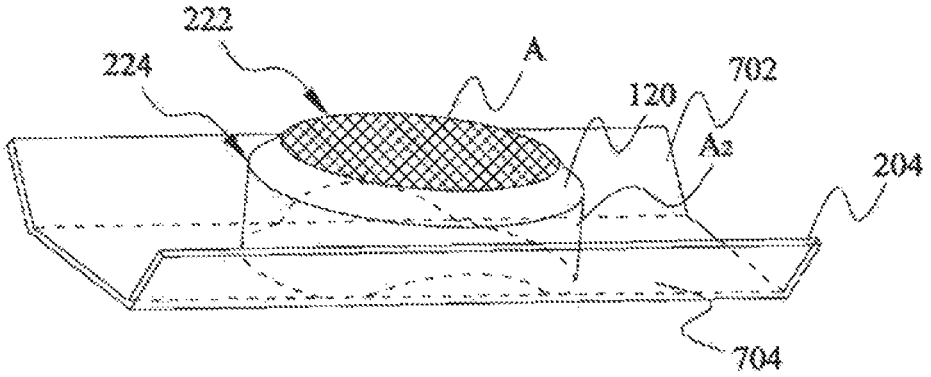
FIGS. 8A-8C are schematic drawings of the relative positional relationship of the inlet pipe and the anti-impact plate in the embodiment shown in FIG. 7A.
Figure 8B:
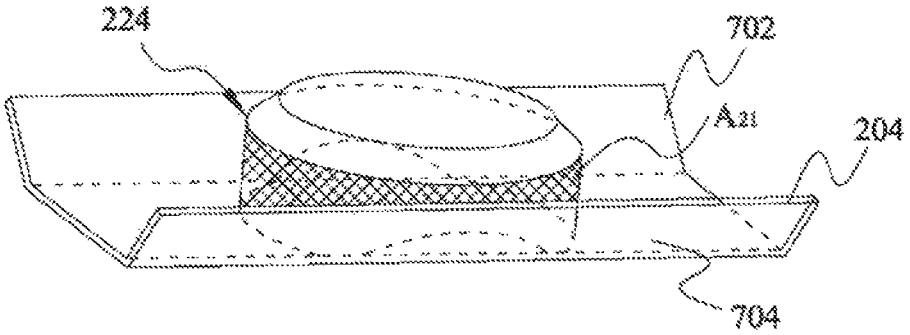
Figure 8C:
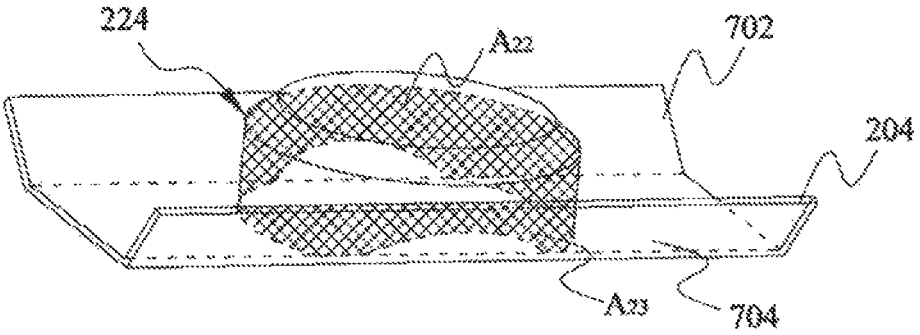

FIGS. 8A-8C are schematic drawings of the relative positional relationship of the inlet pipe 120 and the anti-impact plate 204 in the embodiment shown in FIG. 7A, wherein FIG. 8A is intended to show the inlet area $A_1$ of the inlet 222, and FIGS. 8B-8C are intended to show the outlet extension area $A_2$ of the surface formed by vertically downward extension of the edge of the outlet 224 to the anti-impact plate 204. The area $A_1$ of the inlet 222 shown in FIG. 8A and the method of calculation thereof are the same as in FIG. 6A, so are not described again here. As shown in FIGS. 8B-8C, the sum of a shaded part $A_{21}$ in FIG. 8B and shaded parts $A_{22}$, $A_{23}$ in FIG. 8C is the outlet extension area $A_2$. Specifically, the shaded part $A_{21}$ in FIG. 8B represents a part of the outlet extension area $A_2$ that is visible at the visual angle of FIG. 8B (which is the same as the visual angle of FIG. 8C), the shaded part $A_{22}$ in FIG. 8C represents a part of the outlet extension area $A_2$ that is obscured by the inlet pipe 120 at the visual angle of FIG. 8C (which is the same as the visual angle of FIG. 8B), and the shaded part $A_{23}$ in FIG. 8C represents a part of the outlet extension area $A_2$ that is obscured by the extension part 704 of the anti-impact plate 204 at the visual angle of FIG. 8C (which is the same as the visual angle of FIG. 8B).

It must be explained that in the embodiment shown in FIGS. 6A-6C, the surface of vertically downward extension of the edge of the outlet 224 to the anti-impact plate 204 is a cylindrical surface (i.e. annular). However, in the embodiment shown in FIGS. 8A-8C, the surface formed by vertically downward extension of the edge of the outlet 224 to the anti-impact plate 204 is not a cylindrical surface. Specifically, the surface formed by vertically downward extension of the edge of the outlet 224 strikes the extension parts 702, 704 of the anti-impact plate 204, so a cylindrical surface formed by vertically downward extension of the edge of the outlet 224 will have a part cut away by the extension parts 702, 704; thus, the surface formed by vertically downward extension of the edge of the outlet 224 is not cylindrical between the outlet 224 and the anti-impact plate 204. Therefore, the outlet extension area $A_2$ is not only related to the circumference of the outlet 224 and the gap H between the outlet 224 and the anti-impact plate 204, but also related to the structural shape of the anti-impact plate 204.

Figure 9:
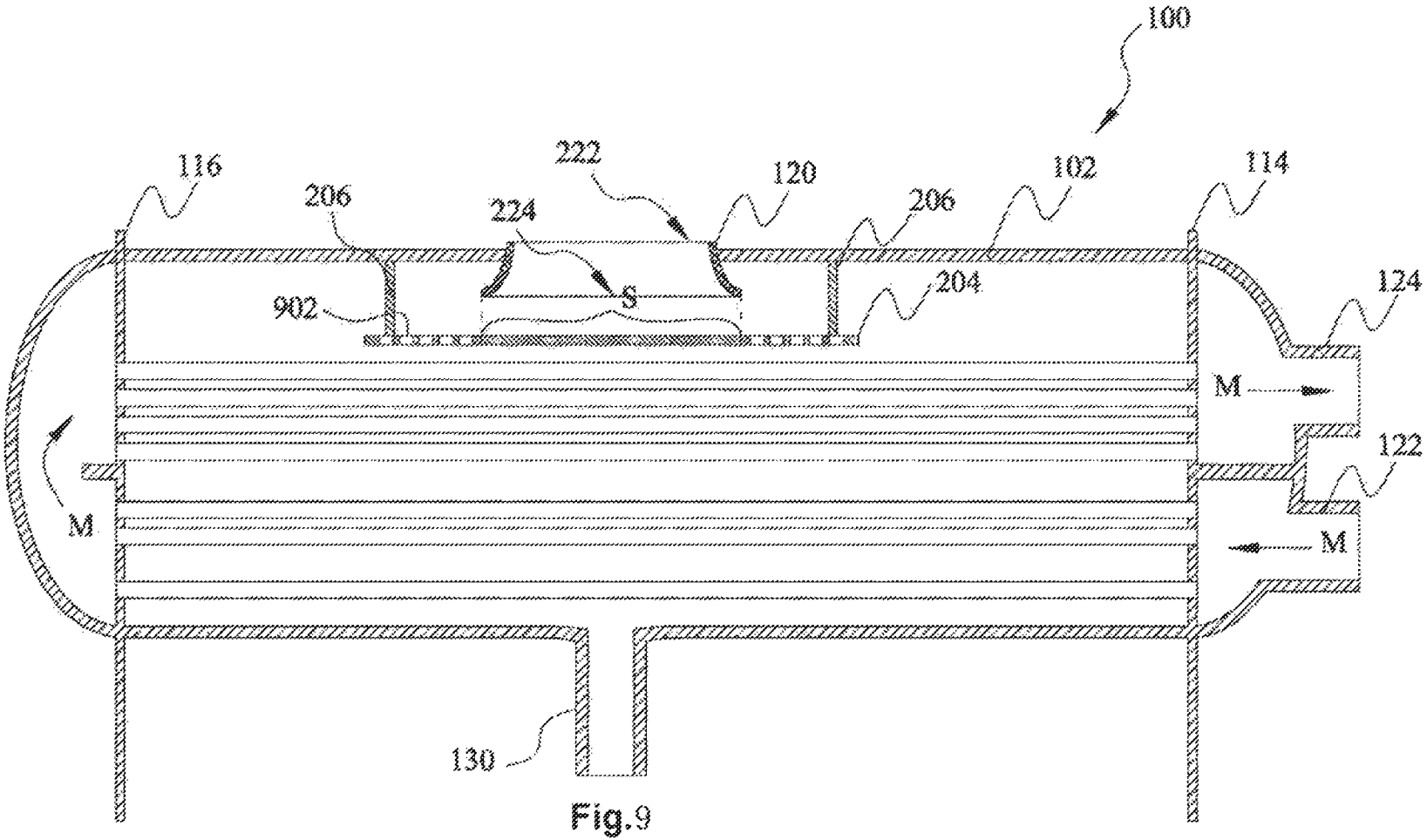
FIG. 9 is a sectional view, taken along section line A-A in FIG. 1, of the condenser according to a further embodiment of the present application.

FIG. 9 is a sectional view, taken along section line A-A in FIG. 1, of the condenser 100 according to a further embodiment of the present application. In the condenser 100 shown in FIG. 9, except for the different structure of the anti-impact plate 204, the configurations of all the other components are the same as in FIGS. 2A-2B, so are not described again here. Specifically, in the embodiment shown in FIG. 9, the anti-impact plate 204 is provided with multiple holes 902; all of the multiple holes 902 are located outside the projected region S, on the anti-impact plate 204, of the outlet 224 of the inlet pipe 120, projected vertically downward along the central axis K of the inlet pipe 120, so that the refrigerant gas can flow toward the first tube bundle 242 more quickly via the multiple holes 902 after being blocked by the anti-impact plate 204. Although the anti-impact plate 204 is provided with the multiple holes 902, since the anti-impact plate 204 under the projected region S is still a flat plate, in the embodiment shown in FIG. 9, the inlet area $A_1$ of the inlet 222 and the outlet extension area $A_2$ of vertically downward extension of the edge of the outlet 224 to the anti-impact plate 204 are calculated in the same way as that expounded in FIG. 7A.

It must be explained that although the anti-impact plate in the present application is substantially configured as a flat plate in each case, those skilled in the art will understand that the anti-impact plate could also be designed to have another shape structure more favorable for the flow of refrigerant gas.

Moreover, although the condenser in the present application is in each case described by taking a shell-and-tube condenser as an example, those skilled in the art will understand that based on the spirit of the present invention, the condenser can not only be a shell-and-tube condenser, but can also be another different form of condenser, such as a tube-in-tube condenser.

Although only some features of the present application have been shown and described herein, many improvements and changes could be made by those skilled in the art. Thus, it should be understood that the attached claims are intended to encompass all of the abovementioned improvements and changes which fall within the scope of the essential spirit of the present application.

The invention claimed is:

1. A condenser, comprising:

a housing having a length and a width, wherein the housing defines an accommodating cavity;

a conduit extending through the housing and defining a flow path into the accommodating cavity, wherein a diameter of the conduit gradually increases from an inlet of the conduit to an outlet of the conduit, wherein the outlet is disposed in the accommodating cavity and defines a distal edge of the conduit, and wherein, in an axial section, a curve of an inner wall of the conduit satisfies one or more curves defined by:

$(x-f)^2+(y-g)^2=h^2$, wherein a range of values of f is greater than −1 and less than 1, a range of values of g is greater than 0 and less than 100, and a range of values of h is greater than 0 and less than 100;

$y=lx^2+mx+n$, wherein a range of values of l is greater than 0, a range of values of m is greater than −10 and less than 10, and a range of values of n is greater than −20 and less than 20;

$y=ox^3+px^2+qx+s$, wherein a range of values of o is greater than 0, a range of values of p is greater than −10 and less than 10, a range of values of q is greater than −20 and less than 20, and a range of values of s is greater than 0 and less than 100; or $$\frac{y^2}{u^2}-\frac{x^2}{v^2}=1,$$

wherein a range of values of u is such that an absolute value of u is greater than 4 and less than 8, and a range of values of v is such that an absolute value of v is greater than 1 and less than 2; and an anti-impact plate separate from the distal edge of the conduit about an entire perimeter of the distal edge and disposed in the accommodating cavity and positioned below the outlet to form a gap extending from a first surface of the anti-impact plate to the outlet, wherein the gap is configured to enable flow of a fluid from the outlet into the accommodating cavity, and wherein the anti-impact plate overlaps with the outlet along the length and along the width and extends radially beyond the conduit relative to a central axis of the conduit.

2. The condenser of claim 1, wherein the outlet has a projected region extending in an axial direction from the conduit onto the anti-impact plate, and wherein the anti-impact plate comprises a hole-free zone within the projected region.

3. The condenser of claim 1, wherein the diameter of the conduit increases smoothly from the inlet to the outlet.

4. The condenser of claim 3, wherein:

the inlet of the conduit has an inlet area $A_1$;

a surface formed by a vertically downward extension of the distal edge of the conduit to the anti-impact plate has an outlet extension area $A_2$; and an AreaRatio of the inlet area $A_1$ to the outlet extension area $A_2$ is greater than or equal to 1.65 and less than or equal to 3.

5. The condenser of claim 4, wherein the outlet extension area $A_2$ is selected based on a circumference of the outlet and the gap.

6. The condenser of claim 1, wherein the anti-impact plate is configured to direct the fluid along the first surface and past an edge of the anti-impact plate.

7. The condenser of claim 1, wherein side edges of the anti-impact plate extending along the length of the housing are bent.

8. The condenser of claim 1, wherein the anti-impact plate is coupled to the housing independently of the conduit via one or more connecting rods extending from the first surface of the anti-impact plate to the housing.

9. A condenser, comprising:

a housing comprising a length and a width, wherein the housing defines an accommodating cavity;

a conduit extending through the housing and into the accommodating cavity, wherein a diameter of the conduit gradually increases from an inlet of the conduit to an outlet of the conduit, wherein the outlet is disposed in the accommodating cavity, and wherein, in an axial section, a curve of an inner wall of the conduit satisfies one or more curves defined by:

$(x-f)^2+(y-g)^2=h^2$, wherein a range of values of f is greater than −1 and less than 1, a range of values of g is greater than 0 and less than 100, and a range of values of h is greater than 0 and less than 100;

$y=lx^2+mx+n$, wherein a range of values of l is greater than 0, a range of values of m is greater than −10 and less than 10, and a range of values of n is greater than −20 and less than 20;

$y=ox^3+px^2+qx+s$, wherein a range of values of o is greater than 0, a range of values of p is greater than −10 and less than 10, a range of values of a is greater than −20 and less than 20, and a range of values of s is greater than 0 and less than 100; or $$\frac{y^2}{u^2}-\frac{x^2}{v^2}=1,$$

wherein a range of values of u is such that an absolute value of u is greater than 4 and less than 8, and a range of values of v is such that an absolute value of v is greater than 1 and less than 2; and an anti-impact plate separate from a distal edge of the conduit about an entire perimeter of the distal edge and disposed in the accommodating cavity and positioned below the outlet to form a gap extending from a first surface of the anti-impact plate to the outlet, wherein the gap is configured to enable a flow of a fluid from the outlet into the accommodating cavity, wherein a first side edge and a second side edge of the anti-impact plate extending along the length of the housing are bent, and wherein the first side edge and the second side edge directly couple the anti-impact plate to the housing independently of the conduit.

10. The condenser of claim 9, wherein the outlet comprises a projected region extending in an axial direction from the conduit onto the anti-impact plate, and wherein the anti-impact plate comprises a hole-free zone within the projected region.

11. The condenser of claim 9, wherein:

the inlet of the conduit has an inlet area $A_1$;

a surface formed by a vertically downward extension of the distal edge of the conduit to the anti-impact plate has an outlet extension area $A_2$; and an AreaRatio of the inlet area $A_1$ to the outlet extension area $A_2$ is greater than or equal to 1.65 and less than or equal to 3.

12. The condenser of claim 11, wherein the outlet extension area $A_2$ is based on a circumference of the outlet and the gap.

13. The condenser of claim 9, wherein the anti-impact plate is configured to direct the flow of the fluid along the first surface and past a third side edge and a fourth side edge of the anti-impact plate into the accommodating cavity.

14. A condenser, comprising:

a housing comprising a length and a width, wherein the housing defines an accommodating cavity;

a conduit extending through the housing and into the accommodating cavity, wherein a diameter of the conduit gradually increases from an inlet of the conduit to an outlet of the conduit, and the outlet is disposed in the accommodating cavity, wherein, in an axial section, a curve of an inner wall of the conduit satisfies one or more curves defined by:

$(x-f)^2+(y-g)^2=h^2$, wherein a range of values of f is greater than −1 and less than 1, a range of values of g is greater than 0 and less than 100, and a range of values of h is greater than 0 and less than 100;

$y=lx^2+mx+n$, wherein a range of values of l is greater than 0, a range of values of m is greater than −10 and less than 10, and a range of values of n is greater than −20 and less than 20;

$y=ox^3+px^2+qx+s$, wherein a range of values of o is greater than 0, a range of values of p is greater than −10 and less than 10, a range of values of a is greater than −20 and less than 20, and a range of values of s is greater than 0 and less than 100; or $$\frac{y^2}{u^2}-\frac{x^2}{v^2}=1,$$

wherein a range of values of u is such that an absolute value of u is greater than 4 and less than 8, and a range of values of v is such that an absolute value of v is greater than 1 and less than 2; and an anti-impact plate separate from the conduit and disposed in the accommodating cavity and positioned below the outlet to form a gap extending from a first surface of the anti-impact plate to the outlet, wherein the gap is configured to enable a flow of a fluid from the outlet into the accommodating cavity, wherein the anti-impact plate is coupled to the housing independently of the conduit via one or more connecting rods extending from the first surface of the anti-impact plate to the housing.

15. The condenser of claim 14, wherein the outlet comprises a projected region extending in an axial direction from the conduit, and wherein the anti-impact plate comprises a hole-free zone within the projected region.

16. The condenser of claim 14, wherein:

the inlet of the conduit has an inlet area $A_1$;

a surface formed by a vertically downward extension of a distal edge of the outlet of the conduit to the anti-impact plate has an outlet extension area $A_2$; and an AreaRatio of the inlet area $A_1$ to the outlet extension area $A_2$ is greater than or equal to 1.65 and less than or equal to 3.

17. The condenser of claim 16, wherein the outlet extension area $A_2$ is selected based on a circumference of the outlet and the gap.

18. The condenser of claim 14, wherein the anti-impact plate is separate from a distal edge of the conduit about an entire circumference of the distal edge.

19. The condenser of claim 14, wherein the anti-impact plate is configured to direct the flow of the fluid along the first surface, across one or more side edges of the anti-impact plate, and into the accommodating cavity.

20. The condenser of claim 14, wherein the outlet of the conduit defines a distal edge of the conduit, and wherein the anti-impact plate is separate from the distal edge of the conduit about an entire perimeter of the distal edge of the conduit.

* * * * *